US012751538B2

(12) United States Patent
Janecke et al.

(10) Patent No.: US 12,751,538 B2
(45) Date of Patent: Oct. 6, 2026

(54) BACKPACK DEVICE

(71) Applicant: Hilti Aktiengesellschaft, Schaan (LI)

(72) Inventors: Andreas Janecke, Landsberg am Lech (DE); Johannes Hammers, Vaduz (LI)

(73) Assignee: Hilti Aktiengesellschaft, Schaan (LI)

( * ) Notice: Subject to any disclaimer, the term of this patent is extended or adjusted under 35 U.S.C. 154(b) by 230 days.

(21) Appl. No.: 18/578,215

(22) PCT Filed: Jul. 18, 2022

(86) PCT No.: PCT/EP2022/070018
§ 371 (c)(1),
(2) Date: Jan. 10, 2024

(87) PCT Pub. No.: WO2023/001740
PCT Pub. Date: Jan. 26, 2023

(65) Prior Publication Data

US 2024/0324755 A1 Oct. 3, 2024

(30) Foreign Application Priority Data

Jul. 20, 2021 (EP) ..... 21186550

(51) Int. Cl.
*A45F 3/04* (2006.01)
*A45F 3/08* (2006.01)
*A45F 3/00* (2006.01)

(52) U.S. Cl.
CPC ..... *A45F 3/047* (2013.01); *A45F 3/08* (2013.01); *A45F 2003/003* (2013.01); *A45F 2003/045* (2013.01)

(58) Field of Classification Search
CPC ..... A45F 2003/003; A45F 2003/045; A45F 3/02; A45F 3/047; A45F 3/06; A45F 3/08; H01M 50/204; H01M 50/256
(Continued)

(56) References Cited

U.S. PATENT DOCUMENTS 5,929,597 A 7/1999 Pfeifer et al.
6,802,442 B1 10/2004 Thompson et al.
(Continued)

FOREIGN PATENT DOCUMENTS

CN 208088846 U 11/2018
CN 110911597 A 3/2020
(Continued)

OTHER PUBLICATIONS

International Search Report of PCT/EP2022/070019 dated Oct. 25, 2022.
(Continued)

*Primary Examiner* — Nathan J Newhouse
*Assistant Examiner* — Matthew T Theis
(74) *Attorney, Agent, or Firm* — Davidson Kappel LLC

(57) ABSTRACT

A backpack device having a harness unit and a battery pack receptacle, fastened thereto, for receiving a battery pack for supplying a hand-held electrical device with energy, wherein the harness unit has a strap adjusting device via which a shoulder strap of the harness unit can be adjusted such that the battery pack receptacle can be moved from a back position into a waist position, wherein the shoulder strap remains, at least partially, on a shoulder of the user with a load-transferring effect.

20 Claims, 2 Drawing Sheets

(58) Field of Classification Search
USPC ..... 224/600
See application file for complete search history.

(56) References Cited

U.S. PATENT DOCUMENTS

| | | | | |
|---|---|---|---|---|
| 11,261,782 | B1 * | 3/2022 | Alvis | H02K 7/1815 |
| 2005/0161305 | A1 | 7/2005 | Jenni et al. | |
| 2014/0011061 | A1 | 1/2014 | Yoshinari et al. | |
| 2016/0198636 | A1 * | 7/2016 | Poole | A01G 20/47 15/327.5 |
| 2016/0260942 | A1 | 9/2016 | Wagner et al. | |
| 2019/0133303 | A1 | 5/2019 | Thiel et al. | |
| 2019/0303884 | A1 | 10/2019 | Boettcher et al. | |
| 2020/0044206 | A1 | 2/2020 | Steffen et al. | |
| 2020/0085172 | A1 | 3/2020 | Nordmann et al. | |
| 2020/0091475 | A1 | 3/2020 | Herrmann et al. | |
| 2020/0113317 | A1 * | 4/2020 | Okumi | A45F 3/04 |
| 2024/0332710 | A1 | 10/2024 | Janecke et al. | |

FOREIGN PATENT DOCUMENTS

| | | | |
|---|---|---|---|
| CN | 117397102 | A | 1/2024 |
| DE | 10 2004 001 550 | | 8/2005 |
| DE | 20 2013 102928 | U1 | 10/2013 |
| DE | 202015006767 | U1 | 12/2016 |
| DE | 102016110462 | A1 | 12/2017 |
| EP | 1380227 | A2 | 1/2004 |
| EP | 3065199 | A1 | 9/2016 |
| EP | 3270437 | A1 | 1/2018 |
| EP | 3462518 | A2 | 4/2019 |
| EP | 3 605784 | A1 | 2/2020 |
| EP | 3 622850 | A1 | 3/2020 |
| JP | 2018100567 | A | 6/2018 |
| WO | WO2023001739 | A1 | 1/2023 |
| WO | WO 2023001740 | A1 | 1/2023 |
| WO | WO2023001741 | A1 | 1/2023 |

OTHER PUBLICATIONS

International Search Report of PCT/EP2022/070018 dated Oct. 25, 2022.

International Search Report of PCT/EP2022/070017 dated Oct. 25, 2022.

WO2023001739 A1—PCT/EP2022/070017, Jan. 26, 2023, National phase filed as U.S. Appl. No. 18/578,178 on Jan. 10, 2024.

WO2023001741 A1—PCT/EP2022/070019, Jan. 26, 2023, National phase filed as U.S. Appl. No. 18/578,129 on Jan. 10, 2024.

WO 2023001740 A1—PCT/EP2022/070018, Jan. 26, 2023, National phase filed as U.S. Appl. No. 18/578,215 on Jan. 10, 2024.

* cited by examiner

BACKPACK DEVICE

The present invention relates to a backpack device having a harness unit and a battery pack receptacle, fastened thereto, for receiving a battery pack. The battery pack is intended to supply a hand-held electrical device, for example a concrete vibrator, with energy.

BACKGROUND

EP 3 605 784 A1 discloses a carrying device having a carrying frame and an energy store carried by the carrying frame.

EP 3 622 850 A1 describes a backpack device for a battery pack, able to be carried on one's back, for supplying hand-held electrical devices with electrical energy, wherein the backpack device comprises a carrying base, a harness unit for the carrying base, and a holding device for releasably holding the battery pack in a carrying position on the carrying base. The holding device comprises a docking device on the carrying base for pivotably docking the battery pack in a docking position and a fixing device on the carrying base for fixing the battery pack in the carrying position, in which it has been pivoted in toward the carrying base compared with the docking position.

SUMMARY OF THE INVENTION

It is an object of the present invention is to specify a backpack device which promotes increased user safety and increased user comfort.

The present application provides that the harness unit has a strap adjusting device by means of which a shoulder strap of the harness unit can be adjusted such that the battery pack receptacle can be moved from a back position into a waist position, wherein the shoulder strap remains, at least partially, on a shoulder of the user with a load-transferring effect.

The invention incorporates the finding that in particular repeated, complete setting down of the backpack device while the battery pack is being exchanged can be associated with health drawbacks, for example muscular strains in the region of the back. The invention has the advantage that a user of the backpack device can exchange a battery pack received or able to be received in the battery pack receptacle without completely setting down the backpack device, when the battery pack receptacle has been moved into the waist position.

In a particularly preferred configuration, the backpack device has two shoulder straps, preferably exactly two shoulder straps. A first of the shoulder straps can be in the form of or be intended to be a left shoulder strap. A second of the shoulder straps can be in the form of or be intended to be a right shoulder strap. The strap adjusting device can be provided in the left and/or in the right shoulder strap.

In a particularly preferred configuration, the shoulder strap can be adjusted in a stepwise manner by means of the strap adjusting device. It has been found to be advantageous when the shoulder strap can be lengthened by means of the strap adjusting device. It has likewise been found to be advantageous when the shoulder strap can be lengthened, if necessary, by a predetermined length set by the user. In a further particularly preferred configuration, the strap adjusting device is in the form of a safety clasp incorporated into the shoulder strap.

Alternatively or additionally, provision can be made for the shoulder strap to be able to be pivoted by means of the strap adjusting device. In a particularly preferred configuration, the harness unit has a waist strap. It has been found to be advantageous when the strap adjusting device is at a distance from the waist strap.

In a further particularly preferred configuration, the shoulder strap has a flexurally elastic shoulder bracket. Alternatively, the shoulder strap can be formed by a flexurally elastic shoulder bracket.

It has been found to be advantageous when the backpack device and/or the harness unit remains free of the battery pack receptacle in its top third, in relation to the total length of the backpack device. As a result, with the strap adjusting device actuated and on account of the Earth's gravity, the backpack device can be moved relatively easily from the back position into the waist position.

In a particularly preferred configuration, the battery pack receptacle has a main battery pack receptacle to which the battery pack can be coupled both electrically and mechanically. In a further particularly preferred configuration, the battery pack receptacle has a secondary battery pack receptacle to which the battery pack can be coupled preferably only mechanically. It has been found to be advantageous when the secondary battery pack receptacle is separate from the main battery pack receptacle and/or is arranged on the backpack device at a distance from the main battery pack receptacle.

In a particularly preferred configuration, the battery pack receptacle has a receiving bay. It has been found to be advantageous when the battery pack receptacle has a cover flap for closing the receiving bay. In a further particularly preferred configuration, the main battery pack receptacle is arranged in the receiving bay. The secondary battery pack receptacle may be arranged on the cover flap. It has been found to be advantageous when the secondary battery pack receptacle is arranged on an inner side of the cover flap. In a further particularly preferred configuration, the cover flap is arranged on the battery pack receptacle so as to be pivotable about a pivot axis with respect to the receiving bay. It has been found to be advantageous when the pivot axis extends in particular parallel to a longitudinal direction of the carrying device.

In a further particularly preferred configuration, the secondary battery pack receptacle is provided with a holding rail, wherein the holding rail has a rail longitudinal direction which extends parallel to the longitudinal direction of the carrying device.

In a particularly preferred configuration, the shoulder strap is a left shoulder strap and the strap adjusting device is provided in the left shoulder strap, wherein the cover flap is fastened on the side of another, in particular right shoulder strap. Alternatively or additionally, the shoulder strap is a right shoulder strap and the strap adjusting device is provided in the right shoulder strap, wherein the cover flap is fastened on the side of another, in particular left shoulder strap.

The invention also provides a backpack system having an above-described backpack device, wherein the backpack system has a battery pack received or able to be received in the battery pack receptacle.

According to an aspect that is able to be protected independently, a backpack device having a harness unit and a battery pack receptacle fastened thereto is specified, wherein the battery pack receptacle is intended to receive a battery pack for supplying a hand-held electrical device with energy. The battery pack receptacle may have a receiving bay and a cover flap for closing the receiving bay. The backpack device according to this aspect that is able to be protected independently can be developed in a corresponding manner by the features that were described with respect to the developments of the backpack device according to the invention.

Further advantages will become apparent from the following description of the figures. Particularly preferred exemplary embodiments of the present invention are illustrated in the figures. The figures, the description and the claims contain numerous features in combination. A person skilled in the art will expediently also consider the features individually and combine them to form useful further combinations.

BRIEF DESCRIPTION OF THE DRAWINGS

Identical and similar components are denoted by the same reference signs in the figures, in which.

DETAILED DESCRIPTION

Figure 1:
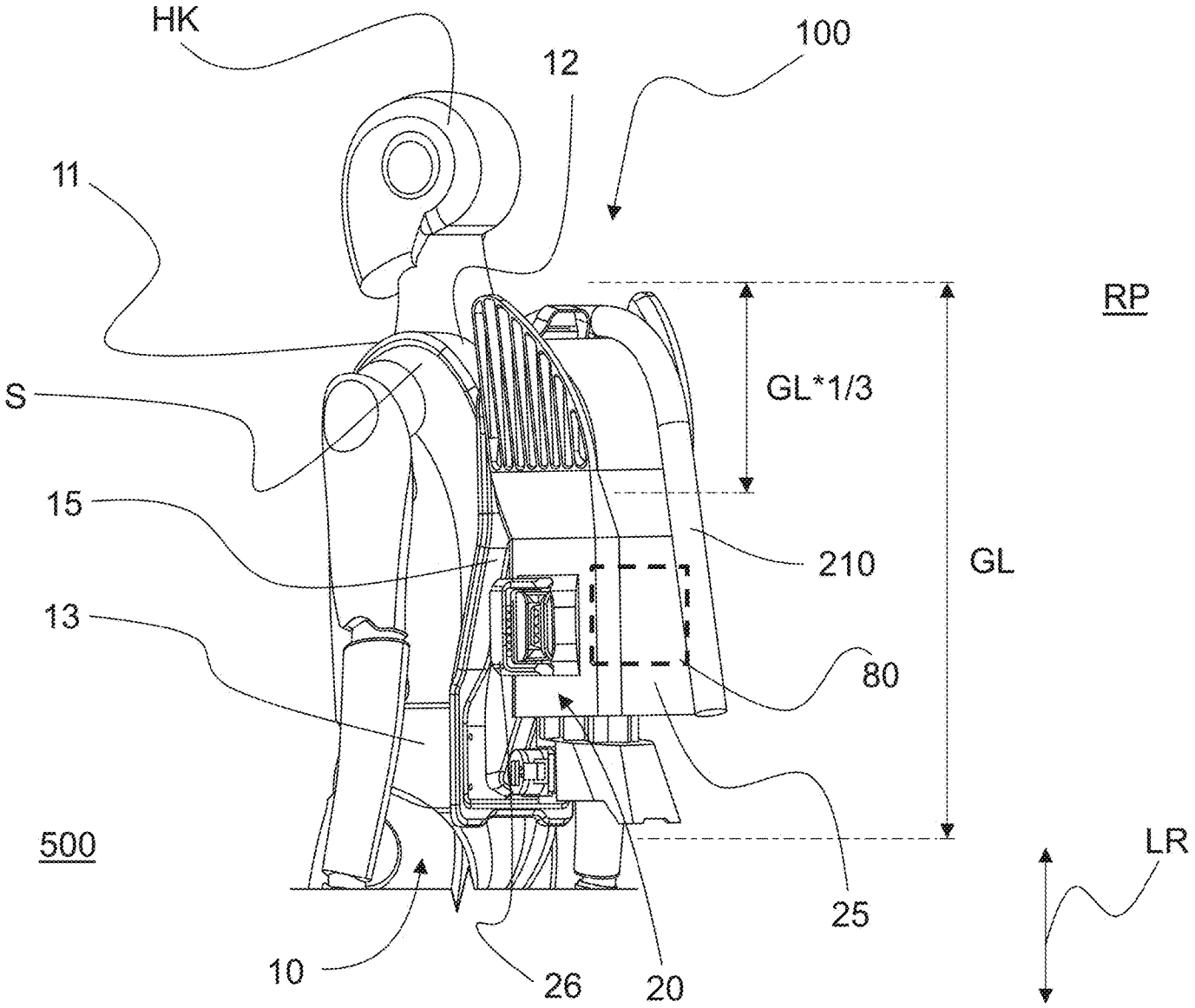
FIG. 1 shows a first preferred exemplary embodiment of a backpack device, wherein the battery pack receptacle is located in a back position.

A first preferred exemplary embodiment of a backpack device 100 according to the invention is illustrated in FIG. 1.

The backpack device 100 is equipped with a harness unit 10 and a battery pack receptacle 20 for receiving a battery pack 80 (illustrated by dashed lines in FIG. 1 since it is located behind the cover flap 25). The battery pack 80 serves to supply a hand-held electrical device 210, for example a concrete vibrator or the like, with energy. Opening the cover flap 25 by means of the flap closure 26, which has for example a handle, allows easy access to the battery pack 80. The backpack device 100 together with a battery pack 80 that is received or able to be received form a backpack system 500. The harness unit 10 has a shoulder strap 11, which rests on a shoulder S of the user HK. The harness unit 10 in FIG. 1 has exactly two shoulder straps, wherein the visible shoulder strap 11 is the left shoulder strap.

The harness unit 10 also has a base plate 15, which is connected to the shoulder strap 11. The shoulder strap 11 may have a flexurally elastic shoulder bracket 12. The battery pack receptacle 20 is in turn connected to the base plate 15. A waist strap 13 of the harness unit 10 supports load transfer from the battery pack receptacle 20.

FIG. 1 shows the battery pack receptacle 20 in the so-called back position RP, meaning in particular that a longitudinal direction LR of the backpack device 100 extends parallel (or at least substantially parallel) to a spine of the user HK. In the back position RP, typically both shoulder straps (only the shoulder strap 11 is discernible in FIG. 1) rest on the shoulders S of the user HK. In the back position RP, the waist strap 13 of the harness unit 10 typically passes around a waist of the user HK.

As can be gathered from FIG. 1, the backpack device 100 has a total length GL in the longitudinal direction LR. The backpack device 100 remains free of the backpack receptacle 20 at least in its top third (GL*⅓). This allows optimal center-of-gravity distribution.

Figure 2:
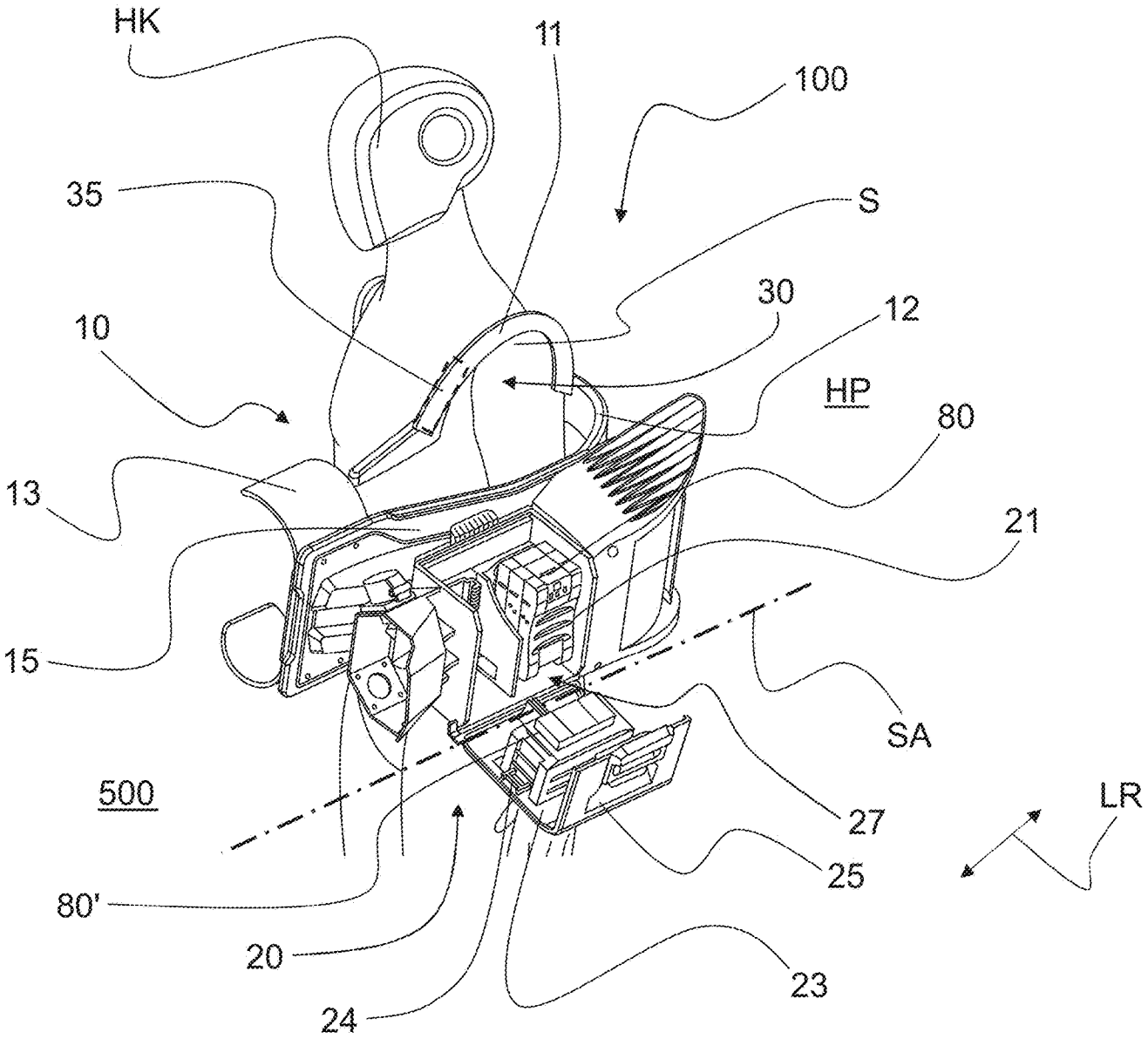
FIG. 2 shows the exemplary embodiment in FIG. 1, wherein the battery pack receptacle is located in the waist position.

FIG. 2 shows the backpack device 100 from FIG. 1, wherein the battery pack receptacle 20 is now located in the so-called waist position HP. The longitudinal direction LR of the backpack device 100 now extends substantially horizontally. According to the invention, the harness unit 10 is equipped with a strap adjusting device 30 by means of which the shoulder strap 11 of the harness unit 10 can be adjusted such that the battery pack receptacle 20 can be moved from a back position RP (cf. FIG. 1) into the waist position HP (cf. FIG. 2), wherein the shoulder strap 11 remains, at least partially, on a shoulder S of the user HK with a load-transferring effect. In the waist position HP, it is relatively convenient to change the battery pack 80.

In the exemplary embodiment illustrated here, the shoulder strap 11 (in this case the left shoulder strap) can be lengthened in a stepwise manner by means of the strap adjusting device 30. This is made possible by the fact that the strap adjusting device 30 is in the form of a safety clasp 35 incorporated into the shoulder strap 11. Compared with the shoulder strap 11 in FIG. 1, the shoulder strap 11 in FIG. 2 has been lengthened, and so the backpack device 100, promoted by the advantageous extension of the battery pack receptacle 20 in the longitudinal direction LR, already described with reference to FIG. 1, could be "swung" into the waist position HP shown in FIG. 2. As can likewise be gathered from FIG. 2, the strap adjusting device 30 in the form of the safety clasp 35 is at a distance from the waist strap 13 and thus particularly conveniently accessible.

The battery pack receptacle 20 of the exemplary embodiment illustrated here has a receiving bay 27 and a cover flap 25 for closing the receiving bay 27. The battery pack receptacle 20 furthermore has a main battery pack receptacle 21, to which the battery pack 80 is coupled both electrically and mechanically. The main battery pack receptacle 21 is arranged within the receiving bay 27. The battery pack receptacle 20 likewise has a secondary battery pack receptacle 23, to which a replacement battery pack 80' (of identical construction to the battery pack 80) can be coupled only mechanically. The secondary battery pack receptacle 23 is arranged on the cover flap 25 on a side of the cover flap 25 facing the receiving bay 27.

In other words: the secondary battery pack receptacle 23 is intended to at least temporarily "store" a replacement battery pack 80' in order to prevent the replacement battery pack 80' from being dropped and typically being damaged in the process.

Access to the receiving bay 27 is made easier in that the cover flap 25 is arranged on the battery pack receptacle 20 so as to be pivotable about a pivot axis SA with respect to the receiving bay 27. The pivot axis SA extends parallel to the longitudinal direction LR of the backpack device 100. In the exemplary embodiment illustrated here, the shoulder strap 11 is a left shoulder strap. The strap adjusting device 30 is provided in the left shoulder strap, wherein the cover flap 25 is fastened on the side of the right shoulder strap (concealed). In order to promote easy positioning of the replacement battery pack 80', the secondary battery pack receptacle 23 advantageously has a holding rail 24, which (and this means the rail longitudinal direction) extends parallel to the longitudinal direction LR of the backpack device 100.

LIST OF REFERENCE SIGNS

10 Hamess unit
11 Shoulder strap
12 Shoulder bracket
13 Waist strap
15 Base plate
20 Battery pack receptacle
21 Main battery pack receptacle

23 Secondary battery pack receptacle
24 Holding rail
25 Cover flap
26 Flap closure
27 Receiving bay
30 Strap adjusting device
35 Safety clasp
80 Battery pack
100 Backpack device
500 Backpack system
GL Total length
HK User
HP Waist position
LR Longitudinal direction
RP Back position
S Shoulder
SA Pivot axis

The invention claimed is:

1. A backpack device comprising:

a harness unit;

a battery pack receptacle fastened to the harness unit for receiving a battery pack for supplying a hand-held electrical device with energy;

the harness unit having a strap adjuster, a shoulder strap of the harness unit adjustable via the strap adjuster such that the battery pack receptacle is moveable from a back position into a waist position where the shoulder strap remains, at least partially, on a shoulder of the user with a load-transferring effect, the strap adjuster being in the form of a safety clasp incorporated into the shoulder strap, the backpack device remaining free of the battery pack receptacle in a top third, in relation to the total length of the backpack device.

2. The backpack device as recited in claim 1 wherein the shoulder strap is adjustable in a stepwise manner via the strap adjuster.

3. The backpack device as recited in claim 1 wherein the shoulder strap is lengthenable or pivotable via the strap adjuster.

4. The backpack device as recited in claim 1 wherein the harness unit has a waist strap, wherein the strap adjuster is at a distance from the waist strap.

5. The backpack device as recited in claim 1 wherein the shoulder strap has a flexurally elastic shoulder bracket.

6. The backpack device as recited in claim 1 wherein the battery pack receptacle has a main battery pack receptacle, the battery pack coupleable both electrically and mechanically to the main battery pack receptacle.

7. The backpack device as recited in claim 6 wherein the battery pack receptacle has a secondary battery pack receptacle, the battery pack coupleable only mechanically to the secondary battery pack receptacle.

8. The backpack device as recited in claim 7 wherein the secondary battery pack receptacle has a holding rail extending parallel to a longitudinal direction of the backpack device.

9. The backpack device as recited in claim 7 wherein the main battery pack receptacle and the secondary battery pack receptacle are positioned perpendicularly to each other.

10. The backpack device as recited in claim 7 wherein the secondary battery pack receptacle is arranged at a distance from the main battery pack receptacle.

11. The backpack device as recited in claim 7 wherein the battery pack receptacle has no other receptacles besides the main battery pack receptacle and the secondary battery pack receptacle.

12. The backpack device as recited in claim 1 wherein the battery pack receptacle has a receiving bay and a cover flap for closing the receiving bay.

13. The backpack device as recited in claim 12 wherein a main battery pack receptacle is arranged in the receiving bay or a secondary battery pack receptacle is arranged on the cover flap.

14. The backpack device as recited in claim 12 wherein the cover flap is arranged on the battery pack receptacle so as to be pivotable about a pivot axis with respect to the receiving bay.

15. The backpack device as recited in claim 14 wherein the pivot axis extends in parallel to a longitudinal direction of the backpack device.

16. The backpack device as recited in claim 12 wherein a main battery pack receptacle is arranged in the receiving bay and a secondary battery pack receptacle is arranged on the cover flap.

17. The backpack device as recited in claim 1 wherein the shoulder strap is a left shoulder strap and the strap adjuster is provided in the left shoulder strap, wherein a cover flap for the battery pack receptacle is fastened on a side of a right shoulder strap.

18. The backpack device as recited in claim 1 wherein the shoulder strap is a right shoulder strap and the strap adjuster is provided in the right shoulder strap, wherein a cover flap for the battery pack receptacle is fastened on a side of a left shoulder strap.

19. A backpack system comprising:

the backpack device as recited in claim 1; and a battery pack received or receivable in the battery pack receptacle.

20. A backpack device comprising:

a harness unit;

a battery pack receptacle fastened to the harness unit for receiving a battery pack for supplying a hand-held electrical device with energy;

the harness unit having a strap adjuster, a shoulder strap of the harness unit adjustable via the strap adjuster such that the battery pack receptacle is moveable from a back position into a waist position where the shoulder strap remains, at least partially, on a shoulder of the user with a load-transferring effect, the battery pack receptacle having a main battery pack receptacle, the battery pack coupleable both electrically and mechanically to the main battery pack receptacle, the battery pack receptacle having a secondary battery pack receptacle, the battery pack coupleable only mechanically to the secondary battery pack receptacle, the secondary battery pack receptacle having a holding rail extending parallel to a longitudinal direction of the backpack device.

* * * * *